United States Patent [19]

Weaver

[11] 3,944,266

[45] Mar. 16, 1976

[54] LATCH FOR SLIDING DOORS

[75] Inventor: Earl W. Weaver, Youngstown, Ohio

[73] Assignee: P.D.I. Inc., Canfield, Ohio

[22] Filed: Apr. 9, 1975

[21] Appl. No.: 566,383

[52] U.S. Cl. ..... 292/145; 292/147; 292/149

[51] Int. Cl.[2] ..... E05C 1/04

[58] Field of Search ..... 292/145, 149, 156, 155, 292/162, 175, 147, DIG. 46; 49/449, 450

[56] References Cited

UNITED STATES PATENTS

| | | | |
|---|---|---|---|
| 410,934 | 9/1889 | Sanders | 292/175 |
| 889,484 | 6/1908 | Parker | 292/149 |
| 904,347 | 11/1908 | Mis | 292/156 |
| 1,301,511 | 4/1919 | Selasky | 292/149 |
| 2,107,773 | 2/1938 | Axe | 49/450 |
| 2,574,807 | 11/1951 | Woodruff | 292/156 |
| 2,768,852 | 10/1956 | Hicks | 292/175 |
| 2,950,756 | 8/1960 | Moloney | 49/449 |
| 3,103,713 | 9/1963 | Ahlgren | 292/50 F |

*Primary Examiner*—Roy D. Frazier
*Assistant Examiner*—Robert A. Hafer
*Attorney, Agent, or Firm*—Webster B. Harpman

[57] ABSTRACT

A latch structure incorporating a housing and a bolt plate movable therein is attachable to an edge of a sliding door adjacent a corner thereof where the bolt plate may move into registry with openings formed in a flanged track in which the sliding door moves. A fastener secures the housing to the edge of the door and a thumb screw engages the bolt plate through a slot in the housing to enable the bolt plate to be moved relative to the housing and secured in fixed position relative thereto.

2 Claims, 3 Drawing Figures

LATCH FOR SLIDING DOORS

BACKGROUND OF THE INVENTION

1. Field of the Invention

This invention relates to sliding doors having their upper and/or lower edges movably positioned in longitudinally extending, vertically spaced tracks and more particularly to latch structures for securing the sliding doors in predetermined positions in said tracks.

2. Description of the Prior Art

Prior structures of this type include rotary latches mounted on sliding doors as in U.S. Pat. No. 3,085,300; vertically movable bolts for engagement with an apertured plate as seen in U.S. Pat. No. 3,103,713 and combinations of vertically sliding bolts and bolt receiving fixtues mounted in tracks for sliding doors as in U.S. Pat. No. 3,698,833.

This invention is particularly suitable for use with sliding doors having their uppermost edges engaged on elongated track sections incorporating longitudinally extending depending flanges which mount the upper edge of the door for movement and insure against its accidental dislocation from the track.

SUMMARY OF THE INVENTION

A latch for a sliding door, at least one edge of which is engaged in a track incorporating longitudinally extending flanges comprises a housing attachable to one edge of the door adjacent an upper corner thereof and slidably mounting a bolt plate that is extendible above the top edge of the door and into locking relation with openings formed in the track on either side of one of the flanges thereon. The housing forms retaining means for the bolt plate and a thumb screw movably engages the bolt plate and extends through a slot in the housing to enable the bolt plate to be controlled thereby.

DESCRIPTION OF THE PREFERRED EMBODIMENT

Figure 2:
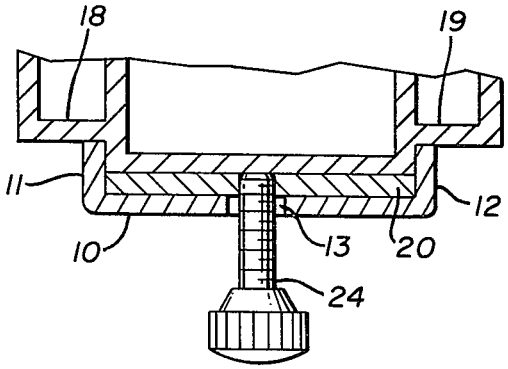
FIG. 2 is a horizontal section on line 2—2 of FIG. 1.

In its simplest form the latch for sliding doors disclosed herein comprises a section of a U-shaped channel including a transversely flat front portion 10 and right angular flanges 11 and 12 on its opposite edges. The front portion 10 is apertured by the formation of a slot 13, a circular inwardly flanged opening 14 and an elongated notch 15 extending inwardly from its uppermost end. A fastener, such as a flat-headed bolt 16, is positioned in the inwardly flanged opening 14 and engaged in a threaded opening in an edge portion 17 of a frame forming part of a sliding door. As illustrated herein the edge portion 17 of the sliding door frame is offset outwardly with respect to side edge portions 18 and 19 of said frame so that the channel shaped housing and more particularly its longitudinally extending edge flanges 11 and 12 will register over the opposite outer edges of the offset edge portion 17 of the door frame as best seen in FIGS. 2 and 3 of the drawings.

The depth of the flanges 11 and 12 is greater than the dimension of the offset of the edge portion 17 with respect to the remainder of the door frame and a space suitable for slidably receiving a bolt plate 20 is thus formed.

Figure 1:
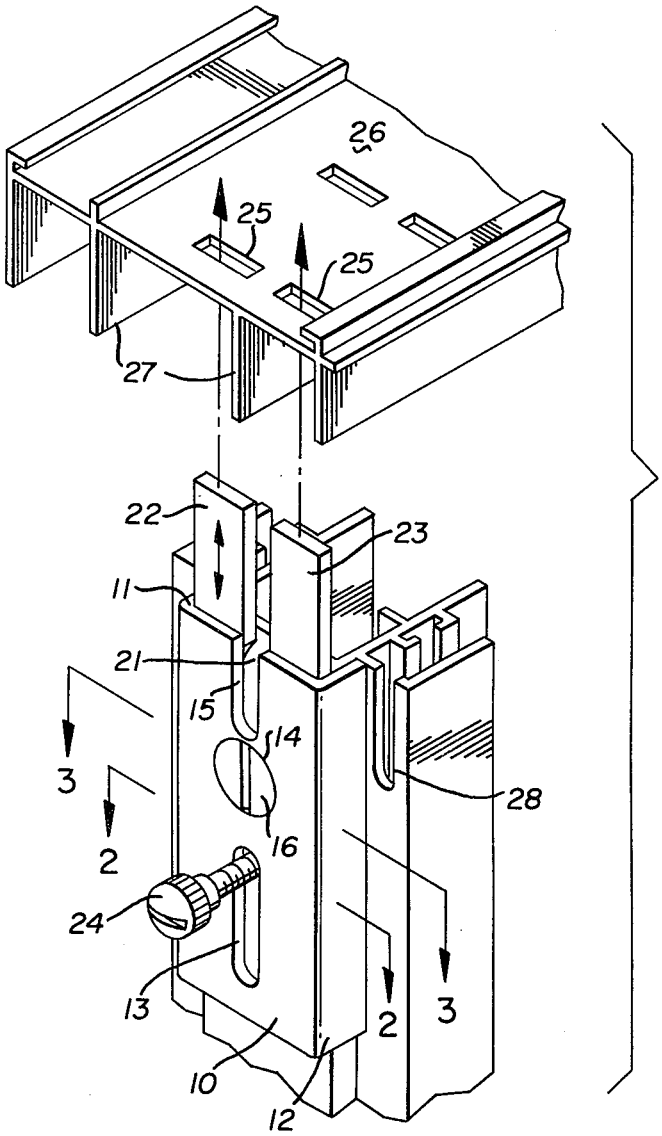
FIG. 1 is an exploded perspective elevation of a portion of a sliding door showing the latch mounted thereon and a portion of a longitudinally flanged track normally engaging the top edge of the door.

By referring now to FIG. 1 of the drawings in particular, it will be seen that the bolt plate 20 is bifurcated by cutting away the central portion thereof as at 21 to form separate upwardly extending bolts 22 and 23 and to form an area around and about the inturned circular flange defining the opening 14 in the front portion 10 of the device wherein the fastener 16 is positioned.

Figure 3:
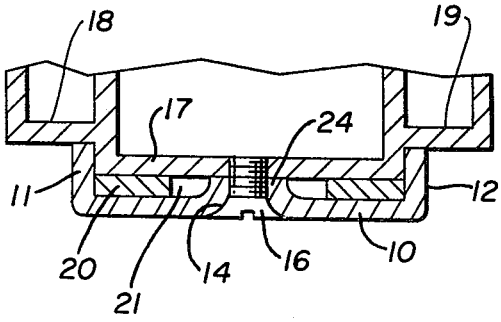
FIG. 3 is a horizontal section on line 3—3 of FIG. 1.

By referring to FIG. 3 of the drawings in particular, it will be seen that the circular flange formed inwardly of the opening 14 in the front portion 10 of the housing and as indicated by the numeral 24 forms a spacer preventing the front portion 10 of the housing from moving into the area in which the bolt plate 20 must slide.

By referring now to FIGS. 1 and 2 of the drawings, it will be seen that a thumb screw 24 is threadably engaged in an opening in the bolt plate 20 below the cutaway area 21 thereof and is positioned so that it extends outwardly through the slot-like aperture 13.

It will thus be seen that the bolt plate 20 and more particularly the flat bolts 22 and 23 thereof may be moved vertically by such motion imparted the thumb screw 24 and that when the flat bolts 22 and 23 are in extended relation to the housing in which they slide, as seen in FIG. 1 of the drawings, they will be in a position to engage apertures 25 of registering shape formed in a base 26 of a flanged track incorporating longitudinally extending flanges 27 which receive and guide the upper edge of a sliding door as will be understood by those skilled in the art.

Still referring to exploded FIG. 1 of the drawings, it will be seen that the upper edge of the sliding door as defined by the frame herein illustrated is notched as at 28 for registry with one of the flanges 27 on the base 26 of the flanged track which guides the upper edge of the sliding door and it will thus be seen that the upper edge of the sliding door is located relative to the apertures 25 in the base 26 so that the flat bolts 22 and 23 may always be engaged therein.

Those skilled in the art will observe that the apertures 25 and 26 may be located to correspond with the position of the flat bolts 22 and 23 when the sliding door on which they are positioned is in closed position in a door opening or the like and that additional pairs of apertures may be formed in the base 26 of the flanged track in spaced relation to the apertures 25 and 26 so that the door on which the latch is positioned can be secured in partially open position.

It will thus be seen that a latch for a sliding door has been illustrated and described herein that is preferably attached to a sliding door having an offset edge portion although it may obviously be attached to the edge of a sliding door that is transversely flat by simply shortening the flanges 11 and 12 of the housing in which the bolt plate 20 is movably positioned or alternately thickening the bolt plate 20 as desired.

In either event, the bolt plate and its bifurcated upper end portion forming the flat bolts 22 and 23 are operable with respect to apertures in the base of the flanged track in which the upper edge of the sliding door is slidably mounted.

Although but one embodiment of the present invention has been illustrated and described, it will be apparent to those skilled in the art that various changes and modifications may be made therein without departing from the spirit of the invention.

Having thus described my invention what I claim is:

1. The combination of a latch and a sliding door having a forwardly offset portion on one of its vertical edges and having its upper edge movably engaged in a flanged track; said latch comprising a housing having a flat front portion and perpendicular, longitudinally extending flanges at its opposite edges positioned over said fowardly offset portion on the vertical edge of the door so as to straddle the same, a central opening in said flat front portion of the housing, a circular inturned flange around said central opening and a fastener positioned through said opening and engaged in said forwardly offset portion of said vertical edge of the door, a bolt plate slidably positioned in the area between the flat front portion of the housing and the offset portion of the edge of the door, a cutaway section in said bolt plate extending inwardly from the upper end thereof to provide clearance for said circular flange and fastener and so as to form spaced flat bolt portions movable outwardly of the housing for registry in spaced openings in said flanged track, an elongated slot in the flat front portion of said housing and a device positioned therethrough and engaged in said bolt plate for adjustable, frictional engagement with the offset portion of the door.

2. The combination of claim 1 wherein said device engaged in said bolt plate is a threaded member positioned in a threaded opening in said bolt plate.

* * * * *